United States Patent [19]

Block

[11] Patent Number: 5,013,373

[45] Date of Patent: May 7, 1991

[54] METHOD FOR TREATING ELECTRICAL STEEL BY ELECTROETCHING AND ELECTRICAL STEEL HAVING PERMANENT DOMAIN REFINEMENT

[75] Inventor: Wayne F. Block, West Chester, Ohio

[73] Assignee: Armco, Inc., Middletown, Ohio

[21] Appl. No.: 488,409

[22] Filed: Mar. 1, 1990

Related U.S. Application Data

[63] Continuation of Ser. No. 173,696, Mar. 25, 1988, abandoned.

[51] Int. Cl.[5] ..... H01F 1/02

[52] U.S. Cl. ..... 148/113; 148/110; 148/122; 204/24; 204/58.5; 204/129.2; 204/181.5

[58] Field of Search ..... 148/110

[56] References Cited

U.S. PATENT DOCUMENTS

| | | | |
|---|---|---|---|
| 3,644,185 | 2/1972 | Benford | 204/140.5 |
| 3,647,575 | 3/1972 | Fielder et al. | 148/111 |
| 3,990,923 | 11/1976 | Takashina et al. | 148/111 |
| 4,123,337 | 10/1978 | Brewer et al. | 204/129.3 |
| 4,203,784 | 5/1980 | Kuroki | 148/111 |
| 4,293,350 | 10/1981 | Ichiyama | 148/111 |
| 4,468,551 | 8/1984 | Neiheisel | 219/212 L |
| 4,535,218 | 8/1985 | Krause et al. | 219/121 LH |
| 4,680,062 | 7/1987 | Shen | 148/111 |
| 4,750,949 | 6/1988 | Kobayashi et al. | 148/111 |

FOREIGN PATENT DOCUMENTS 2167324 5/1986 United Kingdom .

OTHER PUBLICATIONS

M. Yabumoto et al., "Heatproof Domain Refining Method Using Chemically Etched Pits on the Surface of Grain Oriented 3% Si-Fe," *IEEE Transactions on Magnetics*, Sep. 1987, vol. MAG-23, No. 5, pp. 3062-3064.

*Primary Examiner*—John P. Sheehan

*Attorney, Agent, or Firm*—Larry A. Fillnow; Robert J. Bunyard; Robert H. Johnson

[57] ABSTRACT

Permanent domain refinement of grain oriented electrical steel strip is obtained in a high speed two-stage process. The process removes the glass in narrow regions which just expose the base metal. An electrolytic etch is then used to deepen the region into the base metal and minimize damage to the remaining glass film. Control of acid concentration and temperature in the electrolytic bath allows a greater increase in productivity. A further feature of the process is the use of permeability measurements to optimize the depth of the etched regions. The improved core loss produced by the process will survive a stress relief anneal.

10 Claims, 3 Drawing Sheets

METHOD FOR TREATING ELECTRICAL STEEL BY ELECTROETCHING AND ELECTRICAL STEEL HAVING PERMANENT DOMAIN REFINEMENT

This is a continuation of copending application(s) Ser. No. 07/173,696 filed on Mar. 25, 1988, now abandoned.

BACKGROUND OF THE INVENTION

The present invention relates to a high speed electroetching method to provide permanent domain refinement for electrical steels to yield improved magnetic properties.

The core loss properties of electrical steel may be improved by metallurgical means such as better orientation, thinner gauge, higher volume resistivity and smaller secondary grain sizes. Further improvements in core loss are obtainable by non-metallurgical means which reduce the wall spacing of the 180 degree magnetic domains. High-stress secondary coatings impart tension which decreases the width of the domain. The domain refinement of most interest has been the creation of a substruture which regulates the domain wall spacing. Various means to subdivide the domains have included: (1) narrow grooves or scratches by mechanical means such as shotpeening, cutters or knives (2) high energy irradiation such as a laser beam, radio frequency induction or electron beam and (3) chemical means to act as a grain growth inhibitor diffused or impregnated onto the steel surface such as a slurry or solution of sulfide or nitride compounds. All of these means are generally discussed in U.S. Pat. No. 3,990,923. Grooves or scratches have been applied to electrical steels resulting in internal stresses and plastic deformation which subdivides the large domains typically found in large grains into regions of smaller domain sizes. U.S. Pat. No. 3,647,575 uses a knife, metal brush or abrasive powder under pressure to form grooves less than 40×103 mm deep and spaced between 0.1 and 1 mm. The grooves may be transverse to the rolling direction and are applied subsequent to the final anneal. A stress relief anneal of about 700°C. is optional. The Mar. 1979, No. 2, Vol. MAG-15, pages 972–981, from IEEE TRANSACTIONS OF MAGNETICS discussed the effects of scratching on grain oriented electrical steel in an article entitled "Effects of Scratching on Losses in 3-Percent Si-Fe Single Crystals with Orientation near (110) [001]" by Tadao Nozawa et al. The optimum spacing between scratches was from 1.25 mm to less than 5 mm. The benefits of tensile stresses were noted. All of the samples were chemically and mechanically polished prior to scratching to obtain bare, uniformly thick and smooth surfaces for good domain observations using the scanning electron microscope. Scratching was conducted after the final anneal using a ball-point pen loaded with a 300 gram weight to produce a groove which was about 0.1 mm wide and 1 mm deep.

U.S. Pat. No. 4,123,337 improved the surface insulation of electrical steels having an insulative coating by electrochemical treatment to remove metallic particles which protrude above the insulative coating.

U.S. Pat. No. 3,644,185 eliminated large surface peaks by electropolishing while avoiding any significant change in average surface roughness.

The prior art has not optimized the groove depth for permanent domain refinement in a manner which avoids damage to the surface conditions. The prior art has been limited regarding line speed to produce the series of grooves for domain refinement. By using a process which combines grooving techniques with an electrolytic etch, the problems with depth control and surface damage may be overcome. The line speed for this combined process becomes commercially attractive. The present invention provides grooves or rows of pits of sufficient depth to penetrate the coating thickness and then electroetches the exposed base metal to a critical depth to obtain permanent domain refinement.

BRIEF SUMMARY OF THE INVENTION

This invention relates to a high speed, permanent domain refinement process for electrical steels having up to 6.5% silicon and the electrical steel having improved magnetic properties.

Permanent domain refinement is obtained by providing bands of treated areas which penetrate through the mill glass surface. These treated bands could be a continuous line or closely spaced spots. The electrical steel strip is then subjected to an electrolytic etch to deepen the groove or pits. After etching the treated bands, the electrical steel strip is recoated to provide a good surface for an insulative coating which imparts tension.

It is a principal object of the present invention to provide a process which produces permanent domain refinement with improved productivity/lower cost over prior art.

It is a further object of the present invention to provide an electrical steel with improved magnetic properties which may be given a stress relief anneal while maintaining excellent magnetic properties.

It is a still further object to provide a control process for electroetching which monitors the "as-grooved" permeability to optimize the core loss improvement through a feed back control loop.

DETAILED DESCRIPTION OF THE PREFERRED EMBODIMENT

Figure 1:
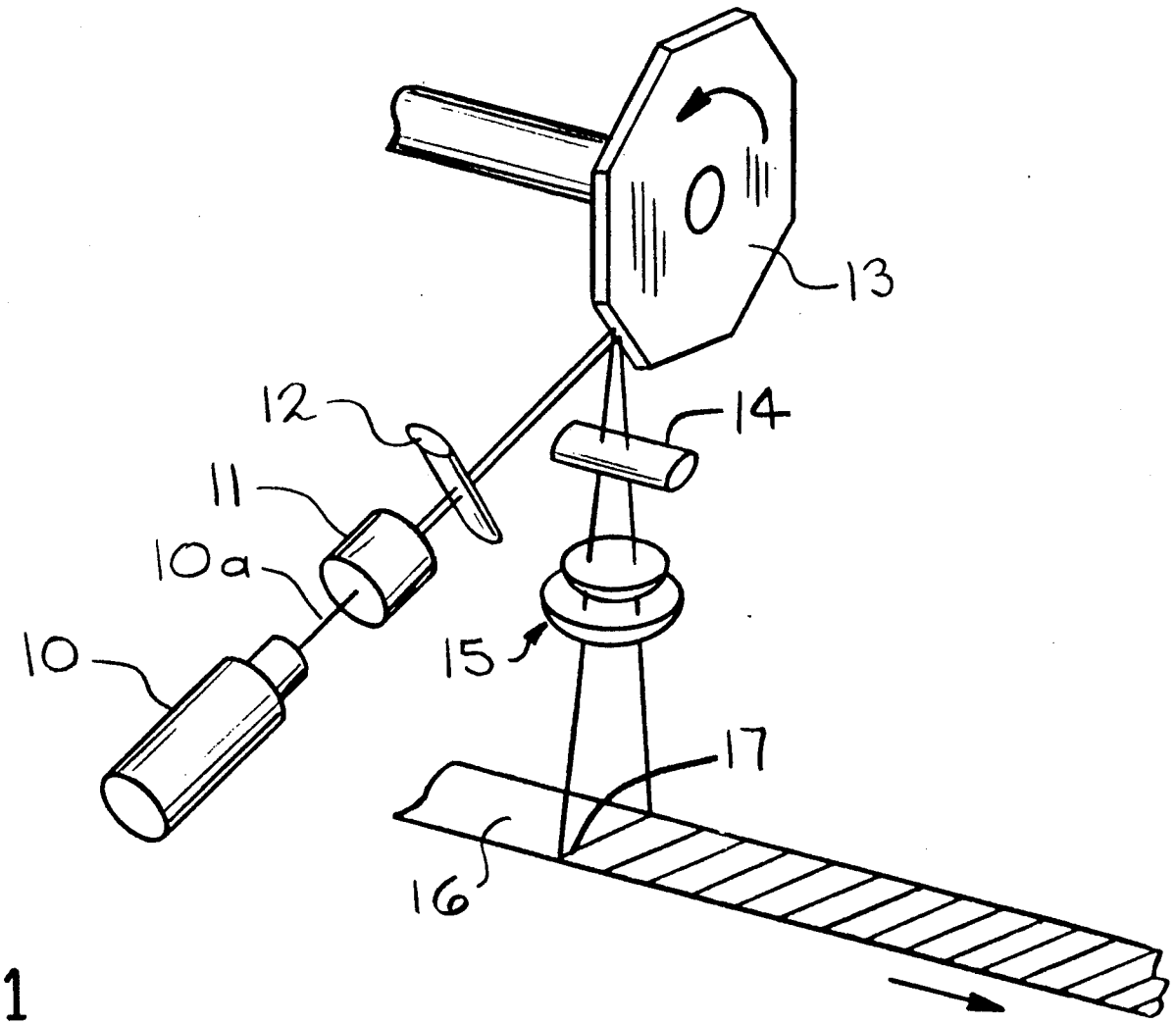
FIG. 1 shows a schematic illustration of a laser system to produce grooves on moving electrical strip.

Domain refinement which will survive a stress relief anneal has not been previously obtainable at normal commercial line speeds. The present invention provides 8–10% core loss improvements after stress relief annealing using a process which can operate at line speeds above 100 feet per minute (30 meters per minute) and typically around 300 feet per minute (90 meters per minute). The reason for this is that the invention produces the permanent domain refinement effect in a matter of seconds as opposed to minutes for other processes.

The steel may have up to 6.5% silicon and may use any of the known grain growth inhibitors. To obtain permanent domain refinement through the thickness of the strip, it is preferable that the gauge be less than 12 mils (30 mm). Heavier gauges will require a domain refinement treatment on each side. However, this is not a problem since the commercial ranges of interest are normally thinner than 12 mils (30 mm).

The first stage of the process is to initiate a series of parallel linear regions in the form of grooves or rows of pits to a depth which just penetrates the glass film and exposes the base metal. U.S. Pat. No. 4,468,551 describes an apparatus for developing spots on electrical steel using a laser, rotating mirror and lenses to focus the shape and energy density of the laser beam. The patent, however, was controlling the laser parameters to avoid coating damage. Laser beams may also be focused into lines by using a lens to expand the laser, a lens to collimate the laser beam, and a lens to focus the laser beam. FIG. 1 shows a laser system which can remove the glass film to expose the base metal.

In FIG. 1, a laser 10 emits a beam 10a which passes through a beam expander 11 and cylindrical lens 12. Laser beam 10a impinges a rotating scanner or mirror 13 which is reflected through a cylindrical lens 14 and lens assembly 15. Beam 10a contacts strip 16 as a line 17. Line 17 is continuously reproduced at spaced intervals of about 5-20 mm. The energy density of laser beam 10a is sufficient to penetrate through the glass coating on strip 16 and expose the electrical steel. Depending on the width of the strip 16, several of these units could be used in combination to produce the grooves in line 17.

Other means to produce the initial groove could also be used, such as discs as taught in EP No. 228,157, or cutters as taught in U.S. Pat. No. 3,647,575, or any of the means in U.S. Pat. No. 3,990,923.

It is important to the magnetic properties of the electrical steel that the grooves or rows of pits which initially penetrate the glass film be very shallow. Deep penetration into the base metal will provide permanent domain refinement but will also produce ridges around the penetration and cause metal splatter on the surface of the glass. Both of these have an adverse effect on the glass film properties. Ideally the initial groove or pits should just remove the glass and expose the base metal slightly. While the depth of the affected region should be shallow, the groove width or pit diameter should be about 0.05 to 0.3 mm.

The second stage for optimizing the depth of penetration uses an electroetching treatment to increase the depth to about 0.0005-0.003 inches (0.012-0.075 mm). Localized thinning by electroetching improves the domain refinement and does not harm the glass film. The improved magnetic quality does remain after a stress relief anneal which is typically at about 1500°-1600° F. (815°-870° C.) for a period of 1-2 hours. The electrolytic bath must be selected to not attack the glass film while deepening the groove or pits in the base metal. Nitric acid solutions (5-15%) with water or methanol were the most effective of the solutions evaluated. A 5% nitric solution in water at 160 F. (70 C.) with a current of 25 mamps/cm$^2$ for 10 seconds attacked the base metal very aggressively without harming the resistivity of the glass. For uniform control, the temperature and acid concentration must be maintained relatively constant.

Figure 2:
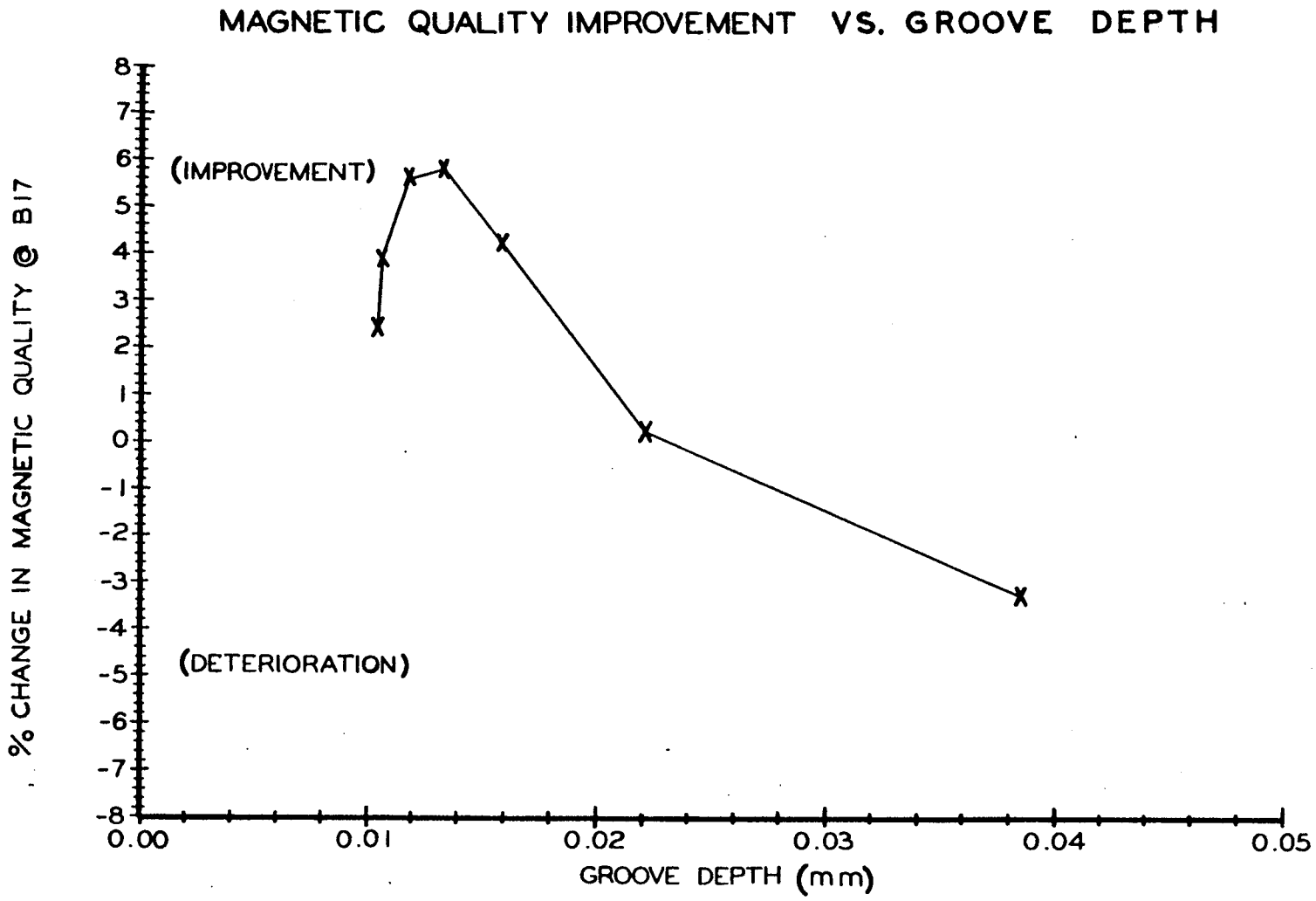
FIG. 2 shows the effect of groove depth on magnetic improvement (deterioration) in percent for grain oriented electrical steel.

FIG. 2 shows the effect of groove depth on the improvement or deterioration of the magnetic quality of high permeability grain oriented steel.

Figure 3:
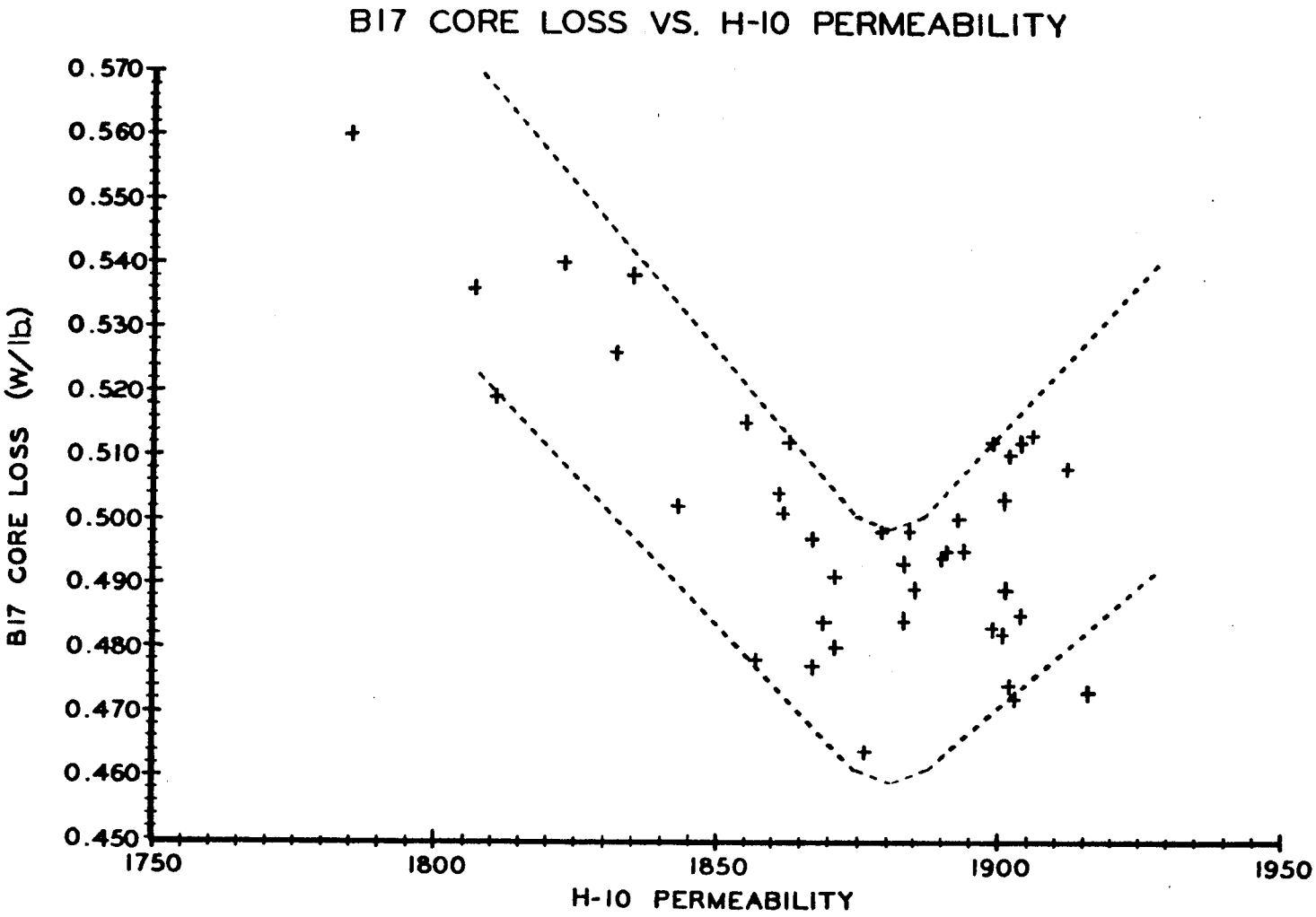
FIG. 3 shows the relationship between permeability and optimum core loss improvement by grooving high permeability grain oriented electrical steel.

The process of scribing and electroetching does have some scatter in the % improvements to magnetic quality. To reduce the scatter and provide a good improvement in core loss, the process may be controlled by monitoring the permeability. A review of FIG. 3 shows the optimum range to be 1870-1890 H-10 permeability (after grooving) to provide minimum scatter in core loss improvement. Before grooving, permeabilities ranged from 1910 to 1940.

During electroetching, a feedback control system is provided which monitors the permeability of the as-grooved steel. Regardless of the starting permeability, the most uniform core loss improvement will occur as the permeability drops into the range of 1870-1890. The control system continues the electroetching until the material falls within this range. This process is more accurately controlled than using such means as the amount of material removed or depth of groove. This control range is applicable only for high permeability grain oriented electrical steel. To maintain line speed during electroetching, the current may be adjusted using the permeability data to control the permanent domain refinement process.

After electroetching, the strip is rinsed and dried. A corrosion inhibitor coating may be applied by roller coating. Potassium silicate mixed in water (about 50 ml/l) could be used. The coating would be cured at 600° F. (315° C.) and cooled.

The width of the scribed line (or spot diameter), time of immersion, current, temperature of the bath, concentration of the acid, initial depth and final depth are all controlled in the process to optimize the permanent domain refinement.

The following experiments were conducted to evaluate the process and optimize the conditions for a high permeability grain oriented silicon steel. Slight modifications may further improve the magnetic properties for different chemistries, gauges, glass film and previous processing differences.

The magnetic characteristics and features of the present invention will be better understood from the following embodiments.

Steel having the following nominal composition (in weight %) was used for these studies:

| % C | % Mn | % S | % Si | % Al | % N |
|---|---|---|---|---|---|
| 0.055 | 0.085 | 0.025 | 3.00 | 0.031 | 0.007 |

After conventional processing to obtain cold rolled strip which has been decarburized, given a final high temperature anneal and provided with a glass film and secondary coating, the strip was subjected to the following tests.

A YAG laser was used to locally remove the glass in parallel regions perpendicular to the rolling direction. The regions were spaced about 6 mm apart. The data in Table 1 compares the magnetic quality of sample blanks with regions of either continuous lines of 0.25 mm in width, or large spots (ellipsoidal in shape) with dimensions 0.4 mm×0.25 mm and 1.2 mm apart, or small spots (also ellipsoid in shape) with dimensions 0.25 mm×0.2 mm and 1.2 mm apart.

The major axis of the ellipsoid spots was perpendicular to the rolling direction. The sample blanks were 0.23 mm thick, 75 mm wide and 300 mm long.

The data in Table 1 is coded by (a) line, (b) large spot (0.4 mm×0.25 mm) and (c) small spot (0.25 mm×0.2 mm). Grooving was done in 5% $HNO_3$ in water at room temperature for about 1 to 2 minutes at 5 amps.

TABLE 1

| Sample | Scribe | Weight Loss (gm) | Calculated Groove Depth (mm) | Initial Core Loss B17 (w/lb) | Initial Perm H-10 | Electroetch Core Loss B17 (w/lb) | Electroetch Perm H-10 | % Imp. (Det.) |
|---|---|---|---|---|---|---|---|---|
| 1 | line | 0.2270 | 0.026 | 0.559 | 1922 | 0.504 | 1861 | 9.8 |
| 2 | line | 0.2409 | 0.028 | 0.600 | 1908 | 0.538 | 1835 | 10.3 |
| 3 | line | 0.2045 | 0.024 | 0.582 | 1919 | 0.497 | 1866 | 14.6 |
| 4 | large spot | 0.0903 | 0.027 | 0.553 | 1917 | 0.513 | 1908 | 7.2 |
| 5 | large spot | 0.0724 | 0.022 | 0.584 | 1905 | 0.552 | 1901 | 5.5 |
| 6 | large spot | 0.0988 | 0.030 | 0.582 | 1919 | 0.527 | 1908 | 9.5 |
| 7 | large spot | 0.1440 | 0.044 | 0.594 | 1919 | 0.518 | 1896 | 12.8 |
| 8 | large spot | 0.1883 | 0.057 | 0.597 | 1919 | 0.508 | 1883 | 14.9 |
| 9 | small spot | 0.0570 | 0.032 | 0.591 | 1919 | 0.546 | 1918 | 7.6 |
| 10 | small spot | 0.0835 | 0.047 | 0.557 | 1931 | 0.496 | 1923 | 11.0 |

The influence of time during electroetching was evaluated on samples of the same chemistry which were mechanically scribed or laser scribed on sample blanks 0.23 mm thick, 75 mm wide and 300 mm long. The scribed lines were spaced apart at 6 mm intervals and were perpendicular to the rolling direction.

Results are shown in Table 2.

TABLE 2

| Sample | Current (amps) | Time (min.) | Groove Depth (mm) |
|---|---|---|---|
| 11* | 4.5 | 0.5 | 0.013 |
| 12 | 4.5 | 1.0 | 0.023 |
| 13* | 4.5 | 1.0 | 0.025 |
| 14 | 4.5 | 2.0 | 0.028 |
| 15* | 4.5 | 2.0 | 0.038 |
| 16 | 4.5 | 3.5 | 0.038 |
| 17 | 4.5 | 5.0 | 0.135 |
| 18* | — | — | 0.002 |

*Scribed with a laser.

Table 3 shows the improvement in core loss with the samples in Table 2 after electroetching. Magnetic properties were measured before scribing and after electroetching followed by a stress relief anneal (SRA) at 1525° F. (830° C.).

TABLE 3

| Sample | Initial Core Loss B15 (w/lb) | Initial Core Loss B17 (w/lb) | Initial Perm. H-10 | Core Loss After SRA 1525° F. B15 (w/lb) | Core Loss After SRA 1525° F. B17 (w/lb) | Perm After SRA 1525° F. H-10 | % Improvement B15 (w/lb) | % Improvement B17 (w/lb) |
|---|---|---|---|---|---|---|---|---|
| 11 | 0.403 | 0.547 | 1928 | 0.397 | 0.535 | 1924 | 1.4 | 2.2 |
| 12 | 0.398 | 0.536 | 1919 | 0.379 | 0.507 | 1902 | 4.8 | 5.4 |
| 13 | 0.407 | 0.562 | 1927 | 0.390 | 0.531 | 1923 | 4.2 | 5.5 |
| 14 | 0.382 | 0.532 | 1906 | 0.379 | 0.519 | 1863 | 0.8 | 2.4 |
| 15 | 0.400 | 0.551 | 1930 | 0.382 | 0.511 | 1902 | 4.5 | 7.2 |
| 16 | 0.392 | 0.531 | 1922 | 0.374 | 0.500 | 1878 | 4.6 | 5.8 |
| 17 | 0.384 | 0.538 | 1904 | 0.422 | 0.559 | 1611 | *9.9 | *3.9 |
| 18 | 0.384 | 0.537 | 1926 | 0.384 | 0.530 | 1921 | — | — |

percent deterioration.

To determine if this process was adaptable to commercial line speeds, a series of tests were conducted with higher acid concentrations (15% $HNO_3$) and higher bath temperatures. All of the bath temperatures were 170° F. (77° C.) except sample 19 which was 175° F. (80° C.). A 5 amp current was used in all cases and the samples were the same size and of the same chemistry as the previous study. Magnetic quality was tested before scribing and after electroetching and stress relief annealing at 1525° F. (830°C.).

TABLE 4

| Sample | Etch Time (sec) | Weight Loss (gm) | Calculated Groove Depth (mm) | Initial Quality Core Loss B17 (w/lb) | Initial Quality Perm. H-10 | Quality After SRA Core Loss B17 (w/lb) | Quality After SRA Perm. H-10 | % Improvement (Det.) |
|---|---|---|---|---|---|---|---|---|
| 19 | 5 | 0.1657 | 0.019 | 0.569 | 1921 | 0.500 | 1893 | 12.1 |
| 20 | 4 | 0.1740 | 0.020 | 0.611 | 1912 | 0.528 | 1883 | 13.6 |
| 21 | 3 | 0.1653 | 0.019 | 0.536 | 1932 | 0.474 | 1902 | 11.6 |
| 22 | 3 | 0.1582 | 0.018 | 0.613 | 1923 | 0.512 | 1898 | 16.5 |
| 23 | 2 | 0.1266 | 0.015 | 0.577 | 1915 | 0.503 | 1901 | 12.8 |
| 24 | 2 | 0.2938 | 0.034 | 0.581 | 1906 | 0.526 | 1833 | 9.5 |

A further study was conducted to optimize the quality improvements to core loss after a stress relief anneal. Mechanical scribing was used to evaluate various depths of grooves through the glass film on the surface of the high permeability grain oriented electrical steel. The scribed lines were spaced 6 mm apart and applied perpendicular to the rolling direction. The electrolytic bath was 5% $HNO_3$ in water at room temperature. As noted previously, higher bath temperatures and higher acid concentrations would allow commercial line speeds but this study was only designed to optimize the depth of the grooves. The samples were the same size, thickness and chemistry as previously stated.

TABLE 5

| Sample | Etched Wgt. Loss (gm) | Groove Depth (mm) | Initial Qlty. Core Loss B17 (w/lb) | Initial Qlty. Perm. H-10 | Electroetch & SRA Core Loss B17 (w/lb) | Electroetch & SRA Perm. H-10 | % Improvement (Det.) |
|---|---|---|---|---|---|---|---|
| 25 | 0.0891 | 0.030 | 0.515 | 1928 | 0.495 | 1894 | 3.9 |
| 26 | 0.0991 | 0.033 | 0.518 | 1929 | 0.489 | 1885 | 5.6 |
| 27 | 0.1328 | 0.043 | 0.523 | 1930 | 0.501 | 1862 | 4.2 |
| 28 | 0.1852 | 0.074 | 0.520 | 1931 | 0.519 | 1811 | 0.2 |
| 29 | 0.3245 | 0.107 | 0.516 | 1926 | 0.533 | 1749 | (3.3) |
| 30 | 0.3570 | 0.117 | 0.526 | 1929 | 0.515 | 1648 | 2.0 |

Various electrolyte etchants and conditions were evaluated in Table 6 for their effect on the glass film quality of the samples. Scribe lines were made mechanically and aligned perpendicular to the rolling direction at 6 mm intervals.

TABLE 6

| Bath | Composition | Electrolyte Etchants 3 cm × 7.6 cm Coupons Temperature (F.) | Current (amps) | Time (sec.) | Glass Film |
|---|---|---|---|---|---|
| 1 | 5% $HNO_3$ in Methanol | RT | 2 | 300 | Pitted |
| 2 | 5% $HNO_3$ + 10% HCl in $H_2O$ | 150 | * | 300 | General Attack |
| 3 | 5% $HNO_3$ in $H_2O$ | RT | 2 | 300 | Pitted |
| 4 | 5% $HNO_3$ + 10% HCl in $H_2O$ | 150 | 2 | 300 | Pitted |
| 5 | 5% $HNO_3$ in $H_2O$ | 150 | 2 | 300 | Okay |
| 6 | 5% $HNO_3$ + 5% HCl in Methanol | RT | 2 | 300 | Slight Attack |
| 7 | 5% $HNO_3$ in $H_2O$ | 160 | 2 | 10 | Okay |
| 8 | 5% $HNO_3$ in $H_2O$ | 160 | 4 | 10 | Okay |
| 9 | 5% $H_2SO_4$ in $H_2O$ | 160 | 2 | 120 | General Attack |

*Hot pickle bath, no electrolysis.

Basically, the damage to the glass film is minimized by keeping times for etching under 10 seconds and using higher currents or bath temperatures to minimize the times. Generally, the preferred composition would be a nitric acid of 5% to 15% concentration in water at 160° F. (70° C.).

The present 2-stage process for permanent domain refinement thus provides improved core loss which remains after a stress relief anneal. The process provides an improved glass surface over the other domain refinement processes which rely on grooves, scratches or rows of spots. The process also provides a unique means of controlling the etching process by monitoring the permeability level. The resultant electrical steel has improved magnetic properties which will survive a stress relief anneal as a result of the 2-stage process which provides a better glass surface.

Modifications may be made in the invention without departing from the spirit of it.

The embodiments of the invention in which an exclusive property is claimed are defined as follows:

1. A high speed method for permanent domain refinement by selective coating and base metal removal in linearly spaced regions on final high high temperature annealed grain oriented electrical steel strip with removal depths controlled for optimum improvements in magnetic quality, said method comprising:

(a) removing said coating in linearly spaced regions having a width of about 0.05 to 0.3 mm and spaced about 5 to 20 mm apart to slightly expose said base metal;

(b) electroetching said expose metal regions to provide a depth from about 0.012 to about 0.075 mm; and (c) monitoring the permeability of said electrical steel during said electroetching and controlling said removal depth in response to the permeability to provide uniform core loss improvement.

2. The method of claim 1 wherein said grain oriented electrical steel strip is high permeability grain oriented electrical steel and said electroetching depth is increased until said permeability is between 1870 to 1890 at 796 amps per meter.

3. The method of claim 1 wherein said strip after electroetching is rinsed and dried.

4. The method of claim 1 wherein a rust inhibitor coating is applied after electroetching.

5. The method of claim 1 wherein a nitric acid bath at a concentration of 5 to 15% in solution with water at a temperature above 40° C. is used for said electroetching with a current of 0.1 to 0.5 amps per square centimeter of said exposed base metal.

6. The method of claim 1 wherein a nitric acid bath at a concentration of 5 to 15% in solution with methanol at a temperature above 40° C. is used for said electroetching with a current of 0.1 to 0.5 amps per square centimeter of said exposed base metal.

7. A method for selective coating and base metal removal at speeds above 100 feet per minute (30 meters per minute) in linearly spaced regions on final high temperature annealed grain oriented electrical steel strip, said method comprising:

(a) laser treating said strip to remove said coating in linearly spaced regions to expose said base metal;

(b) electroetching said strip for a time under 10 seconds with a nitric acid bath at a concentration of 5 to 15% in solution with a liquid selected from the group of water and methanol at a temperature above 40° C. with a current of 0.1 to 0.5 amps per square centimeter of exposed base metal to provide a removal depth of about 0.012 to about 0.075 mm whereby said coating has a minimized damage caused by ridges in said base metal and base metal splatter on said coating; and (c) rinsing said strip.

8. The method of claim 7 wherein a corrosion inhibitor coating is applied after said rinsing step.

9. The method of claim 7 wherein permeability is monitored during electroetching to determine when the electretching is complete and the improvements in magnetic quality are optimized.

10. The method of claim 9 wherein said electroetching is complete when said permeability is between 1870 to 1890 at 796 amps per meter.

* * * * *